US005357758A

United States Patent [19]

Andonian

[11] Patent Number: 5,357,758

[45] Date of Patent: Oct. 25, 1994

[54] ALL POSITION CRYOGENIC LIQUEFIED-GAS CONTAINER

[76] Inventor: Martin D. Andonian, 25 Fairbank Rd., Lexington, Mass. 02173

[21] Appl. No.: 69,444

[22] Filed: Jun. 1, 1993

[51] Int. Cl.[5] ..... F17C 9/02

[52] U.S. Cl. ..... 62/45.1; 62/48.1; 62/50.2; 62/50.4

[58] Field of Search ..... 62/45.1, 50.1, 50.2, 62/50.4, 48.1, 51.1

[56] References Cited

U.S. PATENT DOCUMENTS

| | | | |
|---|---|---|---|
| 1,773,140 | 8/1930 | Heylandt | 62/48.3 |
| 2,260,357 | 10/1941 | Zenner | 62/48.1 |
| 2,842,942 | 7/1958 | Johnston et al. | 62/48.1 |
| 2,945,354 | 7/1960 | Moskowitz | 62/50.2 |
| 3,062,017 | 11/1962 | Balcar et al. . | |
| 3,097,497 | 7/1963 | Fitt | 62/48.1 X |
| 3,263,433 | 8/1966 | Fitt | 62/48.1 X |
| 3,318,307 | 5/1967 | Nicastro | 62/50.2 X |
| 3,570,481 | 3/1971 | Woodberry, Jr. | 62/50.2 X |
| 3,797,262 | 3/1974 | Eigenbrod | 62/48.1 |
| 3,827,246 | 8/1974 | Moen et al. | 62/48.1 X |
| 4,211,086 | 7/1980 | Leonard et al. | 62/48.1 |
| 4,646,525 | 3/1987 | Delacour et al. . | |
| 4,674,289 | 6/1987 | Andonian . | |

*Primary Examiner*—Henry A. Bennett
*Assistant Examiner*—Christopher Kilner
*Attorney, Agent, or Firm*—Hodgson, Russ, Andrews, Woods & Goodyear

[57] ABSTRACT

A cryogenic fluid Dewar container (10) for supplying a gas mixture to an on-demand external delivery device, such as a regulator and associated facepiece (84) independent of the direction of its gravitational field and spatial orientation of the container, is described. The Dewar container holds a volume of cryogenic fluid (24) as a liquefied-gas at a relatively low pressure. A first endothermic heat energy conduction means (58) is mounted outside the Dewar and vaporizes and warms the cryogenic fluid to form a raised-energy fluid that is moved to an exothermic heat energy conduction means (62) mounted inside the Dewar container, which conducts a portion of the added heat energy to the remaining cryogenic fluid. This causes some of the cryogenic fluid to vaporize and raise the pressure inside the Dewar container. The somewhat re-cooled gas flowing through the exothermic heat energy conduction means moves to a second endothermic heat energy conduction means (80) mounted outside the Dewar, which rewarms the gas to about the ambient temperature before delivering the gas to the on-demand facepiece. An economizer valve (88) is provided to move the liquid and/or gas held inside the inner shell directly to the second endothermic heat energy conduction means when the internal pressure exceeds a predetermined level. In addition, the cryogenic fluid Dewar container of the present invention can be provided inside a cool hostile environment body suit (S) to provide an internal cooling system that freezes some of the humidity inside the suit created by prespiration.

36 Claims, 3 Drawing Sheets

ALL POSITION CRYOGENIC LIQUEFIED-GAS CONTAINER

BACKGROUND OF THE INVENTION

This invention relates to a cryogenic fluid Dewar container. More particularly, the present invention relates to a Dewar container holding a volume of cryogenic fluid as a liquefied-gas and comprising a heat exchanger system that is useful for delivering an on-demand supply of breathable air, which has been vaporized from the cryogenic fluid, to a user working in an environment where the air is insufficient to support life. This occurs independent of the spatial orientation of the Dewar and the direction of the encountered gravitational field. At the same time that the heat exchanger system of the present invention is vaporizing the cryogenic fluid to form gas, it also holds the internal pressure at a level which provides adequate flow rates required for breathing.

For purpose of this disclosure, a cryogenic fluid may be regarded as a substance having a boiling temperature below ±150° C.

The Dewar container of the present invention comprises an inner shell which is filled with a cryogenic fluid as a liquefied-gas and is vacuum sealed inside an outer shell. This provides an insulating space between the shells that helps prevent ambient heat transfer to the cryogenic fluid. The Dewar further comprises a plurality of heat exchangers that are connected in series. These heat exchangers are specifically constructed to first vaporize the cryogenic fluid to a gaseous state and then warm the gas to about ambient temperature. The gas, which is preferably a breathable air mixture, is then delivered to a pressure regulator which governs the airflow to an on-demand facepiece worn by the user to support the user's breathing. This air delivery is accomplished without the use of moving parts. A further advantage of the present container over high-pressure gas containers is that the gas is stored as a low (cryogenic) temperature fluid and at a relatively low pressure. Therefore the weight of the low-pressure, cryogenic fluid container is substantially less than the weight of a high pressure gas container holding a comparable volume of breathable air.

PRIOR ART

A unidirectional cryogenic fluid Dewar container is described in U.S. Pat. No. 4,674,289, entitled "Cryogenic Liquid Container", which issued on Jun. 23, 1987 to the inventor herein. In this container, a low-temperature fluid, such as liquid nitrogen, is loaded into and withdrawn from the top of the Dewar container through an input/output liquid conduit tube, extending to the bottom of the container. A pressure building system vaporizes cryogenic fluid drawn from the bottom of the container and re-introduces the resulting gas into the container at an upper position. This forces the remaining cryogenic fluid up through the input/output tube to one or more external heat exchangers connected in series or in parallel outside the container. The heat exchangers conduct ambient heat to the cryogenic fluid in an endothermic process that vaporizes the fluid to a gas and then warms the gas to a usable temperature. Due to the construction of the pressure building system, this container must be in an upright position to ensure proper pressure feed of the cryogenic fluid, especially after the fluid has been partially depleted.

The prior art also describes cryogenic fluid Dewar containers that deliver a gas supply to a pressure regulator for a facepiece independent of the spatial orientation of the Dewar. U.S. Pat. No. 3,827,246 to Moen et al. describes a Dewar container having a pressure control system that is useful for holding the pressure of a single phase cryogenic fluid at or above the critical pressure of the fluid. The pressure control system comprises a preheater coil that conducts ambient heat to a fluid flow from the container and that leads to first and second pressure regulators. If the pressure inside the container exceeds a predetermined range, the first regulator discharges the entire fluid flow through a bypass conduit directly to a discharge line. If the pressure inside the container is within the predetermined pressure range, the second regulator provides an alternate flow path through an internal heat exchanger where a portion of the heat added to the fluid flow by the preheater coil is conducted to the cryogenic fluid held inside the container. From there the somewhat recooled fluid flow goes to a reheater coil which in turn leads to the discharge line. The portion of fluid flow directed to the internal heat exchanger and the portion directed to the discharage line are dependent on the internal pressure since the first and second pressure regulators operate within a predetermined pressure range to divide the fluid flow and maintain a constant internal operating pressure at or above the critical pressure of a subject cryogenic fluid. In the case of oxygen as the cryogenic fluid, the critical pressure is 730 psia and the pressure range will extend from this pressure up to a maximum pressure of 1,500 psia. Controlling such high pressures requires that this Dewar container be made of heavy duty materials. This adds considerable weight to the Dewar which is not particularly desirable for a person engaged in extended periods of strenuous activity, such as firefighting and the like.

In addition to the pressure control system, Moen et al. describes a pressure building circuit wherein cryogenic fluid is drawn from the container, moved through the preheater coil, and then re-introduced back into the container. This warms the cryogenic fluid held inside the container which in turn serves to build internal pressure until the operating pressure is reached. The problem is that the internal heat exchanger is shown diagramatically and as such, does not appear to provide for rapid vaporization of the cryogenic fluid. When the fluid volume drops below a certain level, the pressure control system will not be able to maintain the required critical pressure with the result that the cryogenic fluid will separate into a liquid phase and a gaseous phase. Gas has a relatively low heat transfer capability in comparison to liquid. Once heat transfer slows, the Dewar container will be incapable of maintaining the critical pressure and gas delivery will cease. This is especially apt to occur when the Dewar container is upside down or on its side since the internal heat exchanger is located at the bottom of the container. In the present invention, the internal heat exchanger extends over the entire inside surface of the inner shell for operation in all positions of spatial orientation. The heat exchanger is sized to vaporize liquid air to minimize fractionation.

U.S. Pat. No. 3,062,017 to Balcar et al. describes an oxygen-dispensing container having an internal electrical heater that vaporizes liquid to maintain internal pressure. The container utilizes the fact that oxygen exists as a single phase above 730 psia to provide a usable oxygen supply independent of the gravitational force exerted on the container. One embodiment appears to be orientation independent and has a first external radiant heat exchanger that serves to warm the fluid flow from the container before the warmed fluid is returned to an internal heat exchanger. This internal heat exchanger conducts some of the heat transferred to the warmed fluid flow back to the cryogenic fluid to maintain the required operating pressure inside the container. The somewhat recooled fluid flow then moves to a second external radiant heat exchanger before being delivered to an external delivery system. The problem is that the internal heat exchanger is located at a central location inside the container. This system has the disadvantage of heavy weight because of vaporization above the critical pressure and the electrical heater is impracticable for use where there is not a ready supply of electrical power.

U.S. Pat. No. 3,097,497 to Fitt describes a liquid oxygen container having an external heat exchange and a pressure building, internal heat exchanger. This container is not provided with a second external or reheat heat exchanger and the gas leaving the system may be too cold at relatively high flow rates to be breathable.

There is, therefore, a need for a cryogenic fluid Dewar container that will provide a steady flow of warmed gas at any position or orientation of the container and independent of the direction of the gravitational field. For example, a cryogenic fluid Dewar is needed that provides a readily breathable air supply to active user, such as a firefighter and the like. Firefighters typically move through a burning building in a crawling or prone position or they can move into many unnatural body postures that place the Dewar container in a variety of spatial orientations, deviated from horizontal. Independent of the spatial orientation, the cryogenic fluid Dewar container of the present invention delivers a steady and reliable supply of breathable air to the firefighter. In addition, the cryogenic fluid Dewar container of the present invention can be worn by a firefighter and the like, positioned inside his full body hostile environment suit. That way, the present Dewar container serves to lower the body temperature somewhat during strenuous physical activity and it freezes humidity out of the atmosphere inside the body suit. By providing both body cooling and lower humidity inside the body suit, the firefighter is subjected to less heat stress and can remain physically and mentally alert for more extended periods of time.

OBJECTS OF THE INVENTION

It is therefore an object of the present invention to provide a cryogenic fluid Dewar container for supplying gas from a cryogenic fluid held in the container wherein the orientation limitations of prior cryogenic fluid containers are avoided.

It is an object of the present invention to provide a cryogenic fluid Dewar container that is useful for supplying gas from a cryogenic fluid wherein the container can be tilted substantially from an upright position without interfering unduly with the gas flow therefrom.

It is another object of the present invention to provide a Dewar container for holding a cryogenic fluid supply that produces a relatively steady flow of usable gas without requiring that the container be in an upright position.

It is another object of the present invention to provide a Dewar container for holding a cryogenic fluid that produces a relatively steady flow of gas independent of the spatial orientation of the Dewar container.

It is another object of the present invention to provide a Dewar container that can be worn inside a full body hostile environment suit to supply a firefighter and the like with a readily available supply of breathable air, regardless of the spatial orientation of the vehicle.

It is still a further object of the present invention to provide such a Dewar container that has no internal moving parts and is capable of providing breathable air to a regulator for a facepiece worn by the person breathing the air.

It is a further object of the present invention to provide such a Dewar container that is readily hand portable and provides air for breathing to the individual carrying the container.

These and other objects will become increasingly apparent to those of ordinary skill in the art by reference to the following descriptions and drawings.

IN THE DRAWINGS

FIG. 1 is a partly schematic and partly cross-sectional view showing a cryogenic fluid Dewar container 10 of the present invention comprising an inner shell 14 mounted inside an outer shell 12 and holding the cryogenic fluid 24, together with a first endothermic heat energy conduction means 58, an exothermic heat energy conduction means 62, and a second endothermic heat energy conduction means 80 for transforming the cryogenic fluid 24 to a gaseous state that can be moved to a facepiece 84 to support breathing.

GENERAL DESCRIPTION

Figures 1, 1A:
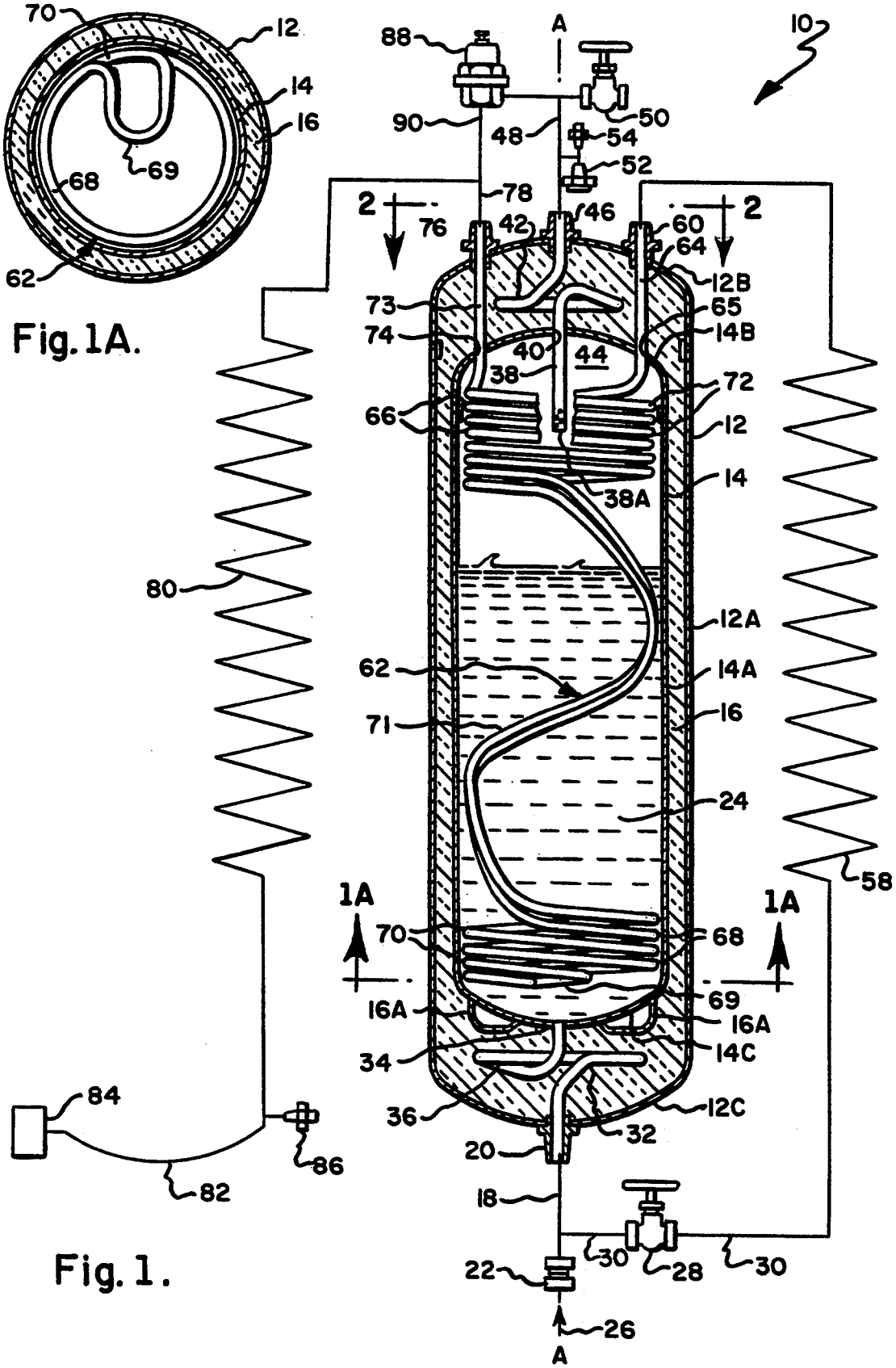
FIG. 1A is a cross-sectioned view along line 1A—1A of FIG. 1.
Figure 2:
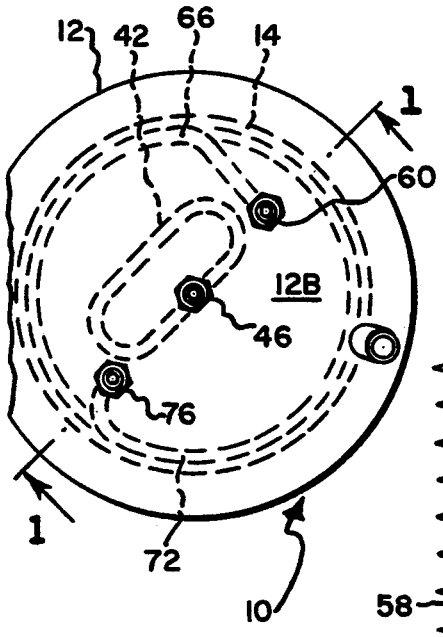
FIG. 2 is a plan view taken along line 2—2 of FIG. 1 and normal to the longitudinal axis A—A of container 10.

The present invention fulfills the need for a cryogenic fluid Dewar container that serves to supply a steady flow of gas, such as breathable air, to a user independent of the spatial orientation of the container. A cryogenic fluid, such as a liquefied-gas, is initially filled into an insulated inner shell. To ensure that the cryogenic fluid is vaporized and then warmed to provide a steady gas flow while maintaining the inner shell gas pressure, an exothermic heat energy conduction means is mounted inside the inner shell and serves to conduct heat energy to the cryogenic fluid. In addition, at least one endothermic heat energy conduction means is mounted outside the container and is connected to the exothermic heat energy conduction means. Preferably there are two endothermic heat energy conduction means, a first one provided before and a second one provided after the exothermic heat energy conduction means.

The first endothermic heat energy conduction means adds heat energy to the cryogenic fluid to provide for initial vaporizing and then warming as the fluid moves from the inner shell and through the first heat energy conduction means. The raised-energy fluid leaving the first endothermic heat energy conduction means is in a gaseous state near ambient temperature with the actual gas temperature dependent on the flow rate through the heat energy conduction means. This gas then moves through the exothermic heat energy conduction means mounted inside the inner shell where thermal energy input into the raised-energy fluid is conducted to the cryogenic fluid still held inside the inner shell. This adds heat energy to the cryogenic fluid inside the inner shell and causes the temperature of the gas flowing through the exothermic heat energy conduction means to cool. The cooled gas in the exothermic heat energy conduction means is then moved to the second endothermic heat energy conduction means where heat energy is again conducted from the ambient surroundings to warm the gas to about ambient temperature before the gas is delivered to the facepiece as a breathable air mixture.

As heat energy is input to the cryogenic fluid held inside the inner shell, some of the cryogenic fluid boils off or vaporizes and the internal pressure rises. However, the rate of heat energy input is dependent on the rate of demand at the facepiece. With no breathing, there is no demand on the system and therefore very little heat energy being added to the cryogenic fluid. On the other hand, if the person breathing from the facepiece is engaged in rigorous activity, there is a proportionate increase in the amount of breathable air that is being drawn off the system. Then, it is important that the amount of heat energy input to the cryogenic fluid via the heat energy conduction means is increased enough to ensure that the cryogenic fluid is boiled off or vaporized at a sufficient rate to support the breathing. If the gas flow through the heat energy conduction means is drawn off the top of the cryogenic fluid, the pressure inside the inner shell will decrease which can lead to fractionation. In that respect, it is important that the vaporization, which forms the gas above the cryogenic fluid, occur at a rate relative to the consumption at the facepiece so that the oxygen content of the vaporized gas remains at a concentration level similar to that of the cryogenic fluid.

Once the pressure inside the inner shell increases no a predetermined level, an economizer valve mounted between the exothermic heat energy conduction means and the second endothermic heat energy conduction means opens. The economizer valve then acts as a short circuit and substantially cuts off the first endothermic heat energy conduction means and the exothermic heat energy conduction means from the cryogenic fluid flow. In this short-circuit "economizer mode" the gas and/or the cryogenic fluid inside the inner shell, depending on the orientation of the container, is fed straight to the second endothermic heat energy conduction means. This vaporizes and warms the gas and/or cryogenic fluid from a low temperature directly to about ambient temperature before delivering the gas to the facepiece.

The economizer mode continues until the pressure inside the inner shell drops below the pressure setting of the economizer valve. The economizer valve then closes and the gas and/or cryogenic fluid again moves through the first endothermic heat energy conduction means where the fluid is vaporized to a gas and the gas is warmed an amount proportionate to the flow rate through the system, as already discussed. The warmed gas then moves into the exothermic heat energy conduction means where heat energy is conducted to the gas and cryogenic fluid held inside the inner shell. This again causes some of the cryogenic fluid to vaporize with the pressure inside the inner shell rising to the setting of the economizer. When the economizer pressure is reached, the economizer opens and the container again operates in the economizer mode, as has been previously discussed. This interaction between the economizer mode and the fully operational mode with all the heat energy conduction means connected to the system is independent of the spatial orientation of the container. Preferably the heat energy conduction means comprises heat exchanger means, although other heat conduction means such as heating coils and the like, which would be an obvious modification to one of ordinary skill in the art, are contemplated by the scope of the present invention.

DESCRIPTION OF THE PREFERRED EMBODIMENT

Turning to FIG. 1, there is shown a cryogenic fluid Dewar container 10 that will first be described in the upright position shown. The Dewar container 10 is comprised of an outer shell or outer container means 12 mounted around and surrounding an inner shell or inner container means 14. The outer shell 12 has a generally cylindrical sidewall 12A along the longitudinal axis A—A with first and second dome portions 12B and 12C closing the opposed ends of the sidewall 12A. Similarly, the inner shell 14 has a cylindrical sidewall 14A along the axis A—A with first and second dome portions 14B and 14C closing the opposed ends of the sidewall 14A. The domes 14B and 14C are preferably spherical- or ellipsoidal-shaped domes.

The space formed between the inner and outer shells 12 and 14 is evacuated to provide a vacuum that helps thermally insulate the cryogenic fluid 24 comprising a liquefied-gas held inside the inner shell 14. An insulation material 16, preferably comprised of aluminum foil with woven glass spacers, is provided in this space. This insulation helps prevent thermal radiation of ambient heat energy through the vacuum space 10 to the cryogenic fluid 24. Often the cryogenic fluid 24 is a liquefied air mixture having an enriched oxygen concentration that serves to supply breathable air to a pressure regulator and associated facepiece 84 to sustain breathing. Aluminized Mylar or vacuum deposited aluminum can also be used as the insulation material 16. Further, a getter material 16A is mounted on the outside of the second dome 14C of the inner shell 14 to adsorb any residual air in the space between the shells 12 and 14.

An input/output liquid conduit 18 extends through a nipple 20 mounted on the second dome 12C of outer shell 12 and leads to a quick-disconnect coupling 22 that connects to a liquefied-gas supply (not shown) for filling cryogenic fluid 24 into the inner shell 14, as shown by arrow 26. To fill the inner shell with cryogenic fluid 24, the coupling 22 is connected to a feed tank (not shown) that is under a pressure. A valve (not shown) in coupling 22 is opened and cryogenic fluid 24 is allowed to fill into the inner shell 14 until the cryogenic fluid 24 blows off through vent valve 50. Vent valve 50 is connected to tube 38, which is sealed at its bottom and provided with a plurality of cross-openings 38A. Preferably, there are four cross-openings 38A that extend upwardly, part way along the length of tube 38 to provide a sufficient vent space at the top of the inner shell 14 above the openings 38A where a gas pocket 44 forms that prevents the inner shell 14 from being overfilled. Once the cryogenic fluid 24 begins to blow off, the valve 50 is closed. The feed tank remains connected to the inner shell 14 until the pressure inside the inner shell 14 is equalized with the pressure of the feed tank. This pressure is preferably a minimum of about 60 psi.

A manual shut-off valve 28 is connected to the input/output conduit 18 between nipple 20 and the coupling 22 via conduit 30. The input/output conduit 18 extends through nipple 20 to a gas trap 32 forming a complete loop in the insulation space 16. Trap 32 enters the inner shell 14 at point 34 and forms a complete 360-degree loop. When valve 28 is closed, the cryogenic fluid 24 fills in the trap 32 to a level marked at 36. The remaining portion of the trap 32 is filled with gas, which is a poor thermal conductor. Independent of the spatial orientation of the container 10, there will always be a high side of the trap 32 above the longitudinal axis A—A that will be filled with gas. The difference between the coefficient of heat transfer of gas to liquid is on the order of magnitude of about ten to as much as a thousand for a boiling liquid. That way, trap 32 helps prevent ambient heat from being conducted to the cryogenic fluid 24 held in the inner shell 14.

Figure 3:
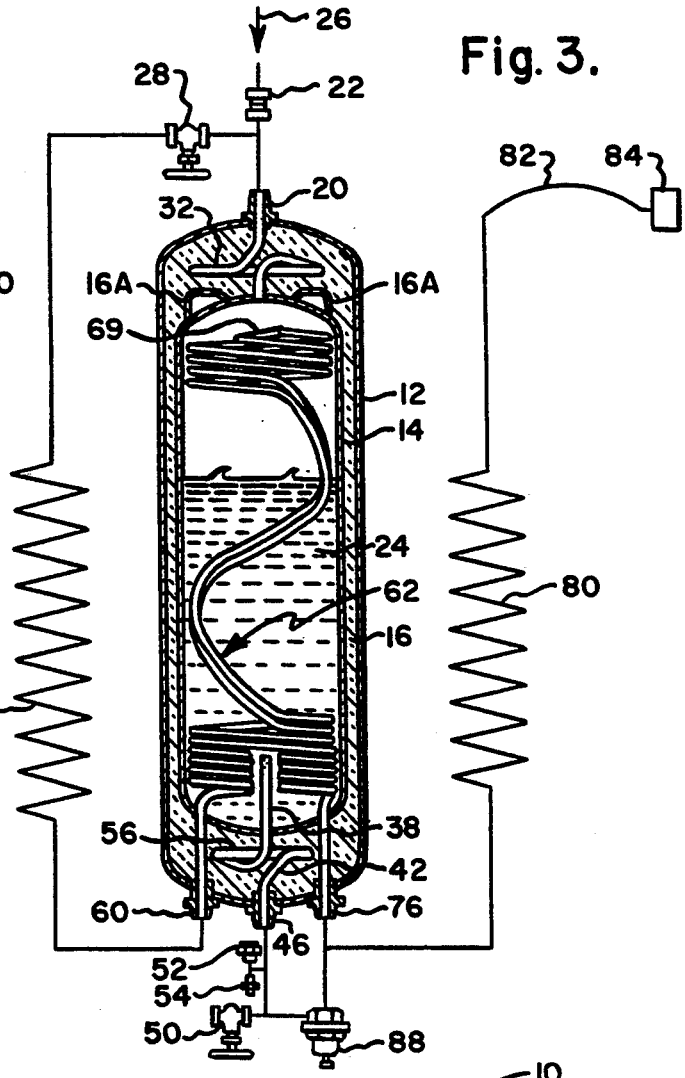
FIG. 3 is a partly schematic and partly cross-sectional view of the cryogenic fluid container 10 of FIG. 1, shown in an inverted position.

Gas vent tube 38 extends from inside the inner shell 14 through the first dome 14B at point 40 and forms into a gas trap 42 comprising a complete loop mounted in the insulation space 16. Trap 42 leads to a nipple 46 connected to an outlet conduit 48. Vent valve 50, burst disk 52, and pressure relief valve 54 are connected to the outlet conduit 48. Trap 42 serves a similar function as trap 32 when the container 10 is inverted (FIG. 3). In the inverted position, the cryogenic fluid 24 is filled in trap 42 to a level marked at 56. The remaining portion of trap 42 is filled with gas. This helps insulate the inner shell 14 from the ambient surroundings since gas is a poor thermal conductor. The traps 32 and 42 are preferably made of a stainless steel material which has a relatively low thermal conductivity. Burst disk 52 is preferably set to actuate at about 400 psi while relief valve 54 is preferably set to actuate at about 235 psi.

As clearly shown in FIG. 1, output conduit 30 leads from the manual shut-off valve 28 to a first endothermic heat energy conduction means 58, which is schematically shown as a heat exchanger in the drawing figures. Heat exchanger 58 is comprised of metal tubing that has been coiled. The tubing is preferably made of aluminum, which has a high thermal conductivity while being lightweight. The first endothermic heat energy conduction means 58 serves to conduct heat energy from the ambient surrounding to the cryogenic fluid 24 as a liquefied-gas to first vaporize the fluid to a gas and then warm the gas. The amount of temperature increase is indirectly proportional to the flow rate through heat energy conduction means 58. If the flow rate is low, the liquefied-gas will be heated from about 300° F. to a temperature approaching the ambient temperature. With an increased flow rate, however, the temperature increase will be less. The tubing may develop frost with an increased flow rate, which will further hinder the heat transfer of exchanger 58.

The warmed gas leaves endothermic heat energy conduction means 58 and re-enters the first dome 12B of the outer shell 12 through nipple 60 leading to an exothermic heat energy conduction means 62. The exothermic heat energy conduction means 62 is shown as a heat exchanger and is mounted inside the inner shell 14 to conduct a portion of the heat energy imparted to the gas in the first endothermic heat energy conduction means 58 to the cryogenic fluid 24 held inside the inner shell 14.

As particularly shown in FIG. 1, the exothermic heat exchanger 62 is comprised of bifilar wound tubing having an inlet portion 64 that enters the inner shell 14 through the first dome 14B at point 65 and extends to a plurality of first coils 66. Coils 66 lead to a first elongated serpentine portion 67 that winds adjacent the inside sidewall 14A and forms into a plurality of second coils 68, positioned adjacent the second dome 14C. A bottommost coil forms into a U-shaped portion 69 that is positioned in a horizontal plane as viewed on FIG. 1A and provides a turnaround for the bifilar wound tubing which in turn leads to a third coiled portion 70 that parallels the second coils 68 in an overlapping relationship. The third coils 70 extend to a second serpentine portion 71 that overlaps the parallel winds of the first serpentine 67. The second serpentine 71 in turn leads to a fourth coiled portion 72 that parallels the first coils 66 in an overlapping relationship and then leads to an outlet portion 73 that exits the first dome 14B at a point 74, diametrically opposite the entrance point 65 of the inlet portion 64. With this configuration, no matter what the spatial orientation the container 10 is positioned, some length of the bifilar wound tubing is at least partially immersed in the cryogenic fluid 24. This ensures a steady rate of heat transfer to the cryogenic fluid 24 and gas held inside the inner shell 14 without a sudden and unwanted increase in gas pressure, as would tend to occur if the serpentine portions 67 and 71 were straight and were mounted along the inside sidewall 14A on only one side of a plane through axis A—A.

Figure 5:
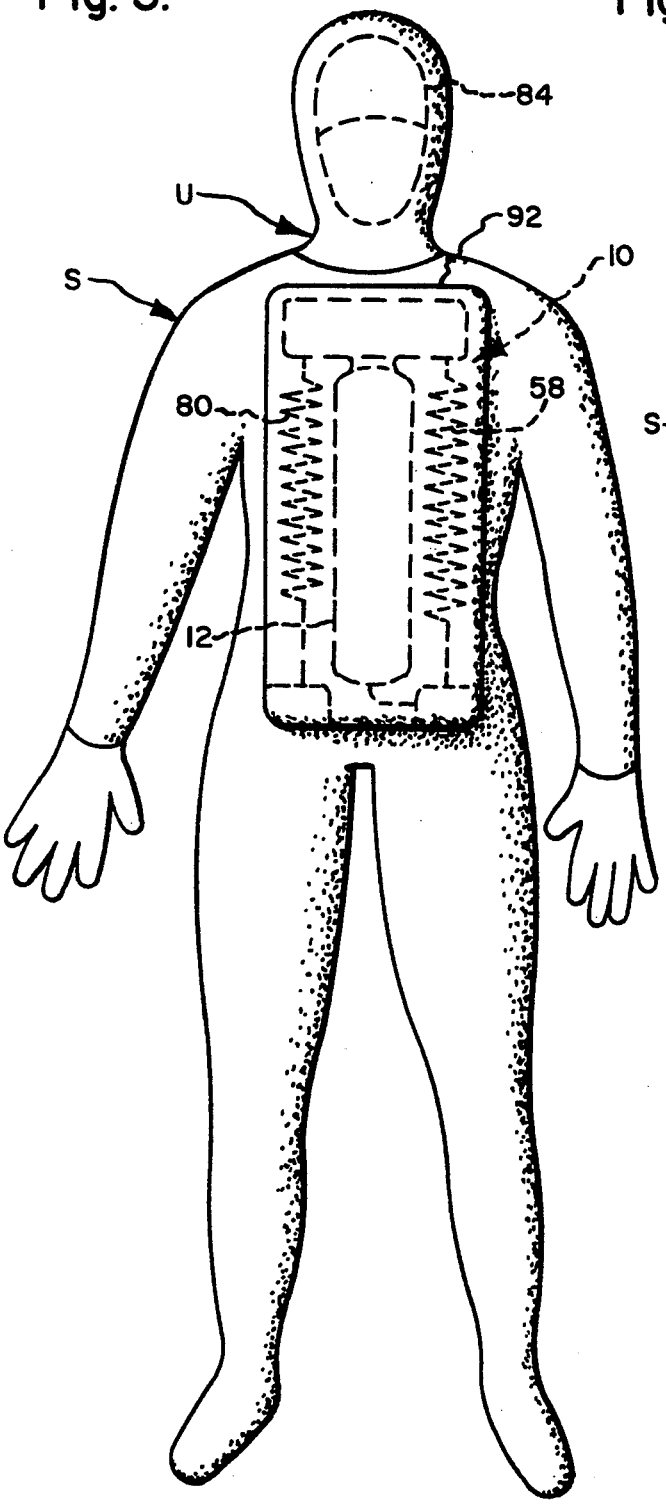
FIG. 5 is a rear elevational view of the user U dressed in a full body hostile environment suit S with the cryogenic fluid Dewar container 10 of the present invention shown in schematic, mounted on the user's back, inside suit S.
Figure 6:
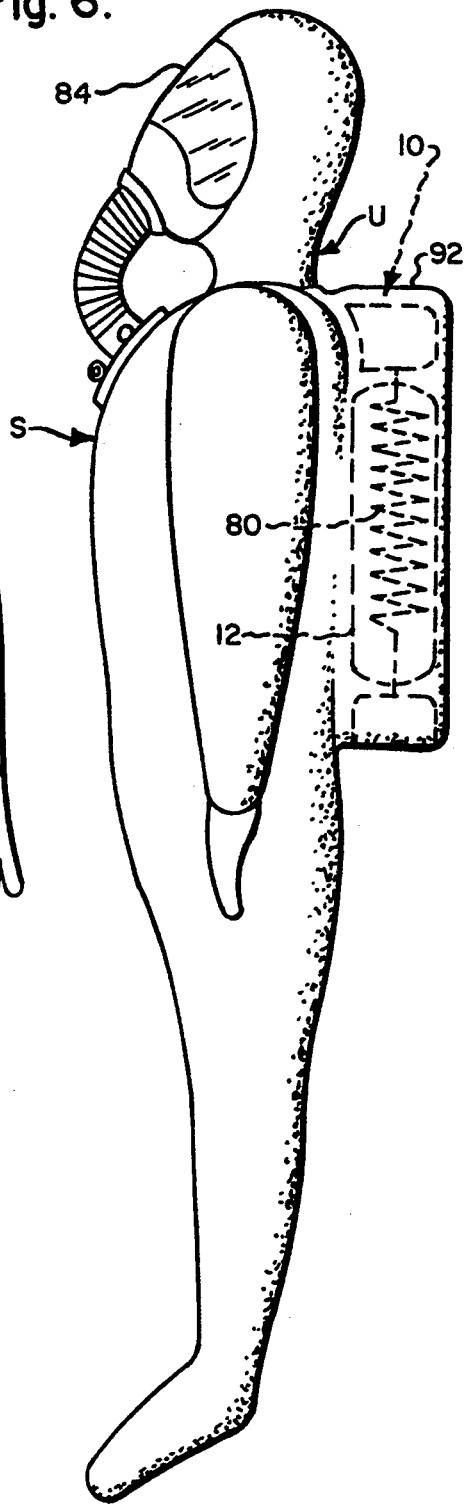
FIG. 6 is a side elevational view of the cryogenic fluid Dewer container 10 shown in schematic in FIG. 5 mounted on the user's U back, inside the full body hostile environment suit S.

The outlet portion 73 of the exothermic heat energy conduction means 62 connects to nipple 76 mounted on the first dome 12B. Nipple 76 leads to a conduit 78 that connects to a second endothermic energy conduction means 80, which is schematically shown as a heat exchanger in the drawing figures and is similar to heat energy conduction means 58. When the warmed gas leaving the first endothermic heat energy conduction means 58 moves through the exothermic heat energy conduction means 62 to conduct heat energy to the cryogenic fluid 24, the temperature of the gas is cooled an amount dependent on the flow rate and the heat energy of the cryogenic fluid 24 is raised a like amount. The cooled gas leaving the exothermic heat energy conduction means 62 then moves to the second endothermic heat energy conduction means 80, and which serves to warm the gas to about ambient temperature. An outboard end of the second endothermic heat energy conduction means 80 connects to a flexible tube 82 that preferably supplies the warmed gas to a pressure regulator and an associated on-demand facepiece 84 (FIG. 1 and 3 to 6 with facepiece 84 shown in block representation on FIGS. 1, 3 and 4), which is worn by a user U breathing the gas (FIGS. 5 and 6). The pressure regulator is preferably set between about 60 and 150 psi. A pressure relief valve 86 is provided adjacent the outboard end of the second endothermic heat energy conduction means 80. Valve 86 is preferably set to actuate at about 200 psi.

An economizer valve 88 is connected by conduit 90 between the outlet conduit 48 leading from the second gas trap 42 and the heat energy conduction means 80. This serves to form a by-pass loop. The economizer valve 88 is actuated when the pressure inside the inner shell 14 exceeds a predetermined pressure. Then, the economizer valve 88 opens and enables gas inside the inner shell 14 to move directly through loop trap 42 and into the second endothermic heat energy conduction means 80. That way, the economizer valve 88 serves to "short circuit" the first endothermic heat energy conduction means 58 and the exothermic heat energy conduction means 62. When the pressure inside inner shell 14 lowers below the pressure setting of valve 88, the economizer valve 88 closes and the cryogenic fluid 24 flows through the heat energy conduction means system as has been previously described. The economizer valve 88 is set to actuate between about 60 and 150 psi, preferably at about 90 psi.

FIG. 3 shows the cryogenic fluid Dewar container 10 in an inverted position. When the pressure inside the inner shell 14 is less than the pressure setting of valve 88, the economizer valve 88 remains closed and the Dewar 10 functions as has already been described in detail. The only difference is that gas at a low temperature is initially drawn from the inner shell 14 and into the first endothermic heat energy conduction means 58. There the gas is warmed an amount indirectly proportional to the flow rate, as previously described. The warmed gas then moves through the exothermic heat energy conduction means 62 to conduct heat energy to the cryogenic fluid 24. When the gas pressure inside the inner shell 14 exceeds the pressure setting of economizer valve 88, valve 88 opens and cryogenic fluid 24 flows directly into the second endothermic heat exchanger 80. There the cryogenic fluid 24 is vaporized to a gas and then warmed to about ambient temperature before moving to facepiece 84 (FIGS. 1 and 3 to 6).

Figure 4:
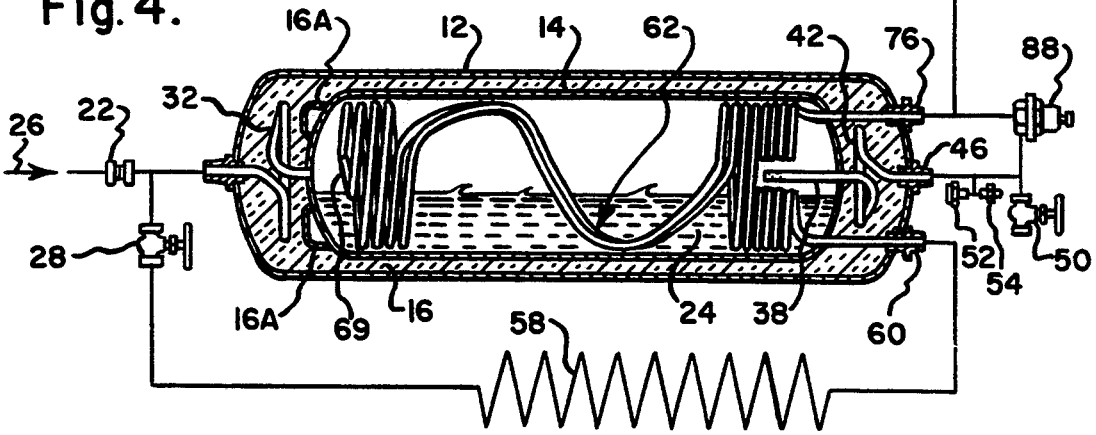
FIG. 4 is a partly schematic and partly cross-sectional view of the cryogenic fluid container 10 shown in FIG. 1 in a sidewardly positioned orientation.

FIG. 4 shows the Dewar container 10 in a sideways position with the level of the cryogenic fluid 24 below the gas vent tube 38 and the inlet to the first gas trap 32. In this position, if the gas pressure inside the inner shell 14 is below the predetermined pressure, economizer valve 88 remains closed and the gas travels through the heat energy conduction means system, as has been previously described. The gas leaving the first heat energy conduction means 58 and moving through the exothermal heat energy conduction means 62 conducts heat energy to the cryogenic fluid 24, which vaporizes some of the cryogenic fluid 24. This raises the internal pressure inside the inner shell 14. Should the gas pressure exceed the pressure setting of economizer valve 88, valve 88 opens and gas flows directly into the endothermic heat energy conduction means 80. There the gas is warmed to about ambient temperature and then moved to the facepiece 84 (FIGS. 1 and 3 to 6).

In the sidewardly oriented position with the cryogenic fluid 24 level above the axis through the gas vent tube 38 and the inlet to trap 32 (not shown), the Dewar 10 functions in a similar manner as that which has been described with respect to the upright position shown in FIG. 1 and the inverted position shown in FIG. 3, depending on the pressure inside the inner shell 14. If the pressure is below the setting for economizer valve 88, Dewar 10 functions according to the upright position with the cryogenic fluid 24 flowing through the successive heat exchangers 58, 62 and 80 and being thereby transformed to a breathable gas for delivery to facepiece 84 (FIGS. 1 and 3 to 6). When the pressure is above the economizer valve 88 setting, Dewar 10 is in the economizer mode and functions according to the inverted position with the cryogenic fluid 24 flowing directly into the second endothermic heat energy conduction means 80. This vaporizes the cryogenic fluid 24 and then warms the gas to about ambient temperature before the gas moves to facepiece 84. Thus, no matter what spatial orientation Dewar 10 is positioned and independent of the flow rate through the system, Dewar 10 is capable of delivering a sufficient amount of breathable gas to facepiece 84 to sustain the user's breathing.

The cryogenic fluid Dewar container 10 shown in FIGS. 1 to 4 is filled with the cryogenic fluid 24 to about 60 pounds per square inch (psi) pressure. Preferably, the cryogenic fluid 24 has been enriched to provide an oxygen concentration of about 40 percent. This raised oxygen concentration ensures that there is a sufficient oxygen concentration in the air supplied to facepiece 84 to support breathing, whether the air is comprised of gas drawn off above the cryogenic fluid 24 or from cryogenic fluid 24 heated through the heat energy conduction means system. In the former case, the oxygen concentration will be at least 21 percent and in the latter case, the oxygen concentration is as high as about 40 percent. The raised oxygen concentration also helps a user engaged in vigorous activity to sustain their heightened activity level for an extended period of time without fatiguing as compared to a user breathing air having an oxygen concentration of about 21 percent.

FIGS. 5 and 6 show one preferred use for the cryogenic fluid Dewar container 10 of the present invention with the user U, such as a firefighter and the like, dressed in a full body hostile environment suit S that covers the user's entire torso along with the legs, feet and arms and includes gloves for protecting the hands and a hood for protecting the head and neck parts of the body. The hood seals around the perimeter of the facepiece which provides a gas supply from the cryogenic fluid Dewar contained 10, as previously described in detail. A back portion of the body suit S has a compartment 92 that provides for housing the Dewar 10 mounted on the user's back by a harness (not shown), as is well known to those of ordinary skill in the art.

As shown with reference to the orientation of FIGS. 5 and 6, mounting the Dewar container 10 inside the body suit S provides an internal counter current cooling system for the user's body. This counter current airflow is set up by the presence of warm air inside the suit, heated by the body. The user's level of activity dictated the degree to which this internal warming takes place. As previously described in detail, the cryogenic fluid 24 leaves the inner shell and enters the first external heat exchange 58 at a position adjacent the second dome portion 12C. Heat energy is added there to the cryogenic fluid 24 from the ambient surroundings to provide a raised energy fluid leaving the first external heat exchange 58 at a position adjacent the first dome portion 12B and at an upper portion in compartment 92 given the orientation of the user as shown. The cryogenic fluid 24 leaving the inner shell 14 provides body cooling by cooling the air inside the body suit and thereby causing some of the humidity inside the body suit created by perspiration to freeze and form frost on the heat exchanger 58 coils. This frost decreases the relative humidity inside the body suit which together with the body cooling results in a more comfortable environment for the user. Third external heat exchanger 80 also serves to remove humidity in a similar manner. The first and third external heat exchanges 58 and 80 have a sufficient amount of capacity to continue functioning even when a frost build-up occurs on the coils.

In addition, the decreased air temperature at the lower position inside compartment 92 sets up a convection flow with the warmer air at the upper part of compartment 92. This airflow runs countercurrent to the flow of cryogenic fluid 24 through the first external heat exchange 58 and serves to reduce the user's body temperature to a degree relative to the user's activity level and thus the flow of cryogenic fluid 24 through the system. In that result, the cryogenic liquefied Dewar container 10 of the present invention provides a means for reducing the relative internal humidity inside the body suit S to thereby lower the user's body temperature an amount relative to the user's activity level. A lower relative humidity decreases the stress level under which the user must work when he is working in a hostile environment, such as fighting a fire and the like. It should be understood that cryogenic fluid Dewar container 10 can also be mounted on the user's back, outside of the suit S, although this is not preferred.

For one-hour rated unit, inner shell 14 holds between about 6.5 to 7.0 pounds of cryogenic fluid 24, which has a gaseous equivalent (STP) of between about 2,400 to 2,600 liters. For a two-hour rated unit, inner shell 14 holds between 13 to 14 pounds of liquefied-air which has a gaseous equivalent (STP) of between about 4,800 and 5,200 liters. This rated duration is for a 40 liter-minute volume respiration rate. In addition, Dewar 10 provides improved safety because it operates at a maximum of 235 psi instead of between about 2200 to 4500 psi for compressed gas cylinders.

It is intended that the foregoing description be only representative of the present invention and that the present invention be only limited by the hereinafter appended claims.

What is claimed is:

1. An apparatus that is useful for holding a cryogenic fluid comprising a liquefied-gas and a gas, and that provides for conducting heat energy to the liquefied-gas and the gas independent of the direction of the gravitational field and the spatial orientation of the apparatus to produce a breathable gas from the cryogenic fluid, which comprises:

(a) inner container means provided to hold the cryogenic fluid;

(b) insulation means housing the inner container means in a surrounding relationship to retard ambient heat conduction and radiation to the liquefied-gas and the gas comprising the cryogenic fluid held in the inner container means;

(c) first heat energy conduction means mounted outside the inner container means and in fluid flow communication with the inside of the inner container means, wherein the liquefied-gas and the gas comprising the cryogenic fluid held in the inner container means are movable through the first heat energy conduction means to conduct heat energy to the cryogenic fluid and provide a raised energy fluid;

(d) second heat energy conduction means mounted inside the inner container means and at least partially immersed in the liquefied-gas independent of the spatial orientation of the apparatus, wherein the raised-energy fluid from the first heat energy conduction means is movable through the second heat energy conduction means to conduct heat energy from the raised-energy fluid to the liquefied-gas still held in the inner container means; and (e) third heat energy conduction means mounted outside the inner container means and connectable for fluid flow communication with the raised-energy fluid movable through the second heat energy conduction means and for fluid flow communication with the liquefied-gas and the gas comprising the cryogenic fluid held inside the inner container means, wherein the third heat energy conduction means provides for conducting heat energy to the raised-energy fluid moved through the second heat energy conduction means and to the cryogenic fluid moved directly from the inner container means to the third heat energy conduction means to provide the breathable gas.

2. The apparatus of claim 1 wherein the first, second and third heat energy conduction means are heat exchanger means.

3. The apparatus of claim 2 wherein the heat exchanger means are connected in series and wherein the first and third heat exchanger means are endothermic and wherein the second heat exchanger means is exothermic.

4. The apparatus of claim 1 further comprising a by-pass means mounted between the second and third heat energy conduction means, wherein the by-pass means provides for selectivity in moving the liquefied-gas and the gas comprising the cryogenic fluid directly from the inner container means to the third heat energy conduction means when the pressure inside the inner container means exceeds a predetermined level.

5. The apparatus of claim 1 wherein the cryogenic fluid is comprised of a breathable air mixture containing oxygen and nitrogen.

6. The apparatus of claim 1 wherein the insulation means is comprised of an outer container means housing the inner container means in the surrounding relationship with an insulation material provided in a space formed between the inner and outer container means.

7. The apparatus of claim 6 wherein a vacuum is provided in the space between the inner and outer container means.

8. The apparatus of claim 6 wherein the insulation material is selected from the group consisting of aluminum foil having a woven glass spacer material, aluminized Mylar, and vacuum deposited aluminum.

9. The apparatus of claim 1 wherein the second heat energy conduction means is comprised of a bifilar wound conduit means.

10. The apparatus of claim 1 wherein the second heat energy conduction means is comprised of a conduit means mounted inside the inner container means and wherein the inner container means is comprised of a surrounding inside sidewall having opposed ends along a longitudinal axis and closed by a first and a second closure means and wherein the conduit means comprising the second heat energy conduction means includes an inlet portion that enters the inner container means through the first closure means and extends to a first coiled portion that wraps annularly around the axis at least one time adjacent to the first closure means and then extends to a first serpentine portion that winds annularly around the axis at least one time while extending towards a second coiled portion which wraps annularly around the axis at least one time adjacent to the second closure means before forming into a third coiled portion that wraps annularly around the axis at least one time adjacent to the second closure means and wherein the third coil portion extends to a second serpentine portion that winds annularly around the axis at least one time while extending to a fourth coiled portion that winds annularly around the axis at least one time adjacent to the first closure means before extending to an outlet portion that exits the inner container means through the first closure means.

11. The apparatus of claim 10 wherein the surrounding inside sidewall comprising the inner container means has a cylindrical shape along and around the first longitudinal axis and wherein the first and second closure means are spherical- or ellipsoidal-shaped dome members that close the opposed end of the cylinder.

12. The apparatus of claim 4 wherein the inner container means is comprised of a surrounding inside sidewall having opposed first and second ends along a longitudinal axis that are closed by a first and a second closure means and wherein the insulation means is comprised of an outer container means housing the inner container means in the surrounding relationship with an insulation material provided in a space formed between the inner and outer container means.

13. The apparatus of claim 12 wherein a first trap means is mounted in the space provided between the inner and outer container means and connects between the inside of the inner container means through the first closure means to the by-pass means and wherein the first trap means retards heat-energy conduction through the outer container means to the inner container means through the first closure means, and wherein a second trap means is mounted in the space provided between the inner and outer container means and connects between the inside of the inner container means through the second closure means to the first conduction means and wherein the second trap means retards heat-energy conduction through the outer container means to the inner container means through the second closure means.

14. The apparatus of claim 13 wherein the first and second trap means are made of a material having a low thermal conductivity.

15. The apparatus of claim 14 wherein the material having the low thermal conductivity is stainless steel.

16. The apparatus of claim 1 wherein the apparatus is adapted to be worn by a user and to be provided inside a body suit means, and wherein the heat energy conducted to the cryogenic fluid by the first heat energy conduction means and to the raised-energy fluid by the third beat energy conduction means serves to withdraw heat energy from inside the suit means to thereby provide body cooling and decrease the relative humidity inside the suit means.

17. An apparatus that is useful for holding a cryogenic fluid comprising a liquified-gas and a gas, and that provides for conducting heat energy to the liquefied-gas and the gas independent of the direction of the gravitational field and the spatial orientation of the apparatus to produce a breathable gas from the cryogenic fluid, which comprises:

(a) inner container means provided to hold the cryogenic fluid;

(b) insulation means housing the inner container means in a surrounding relationship to retard ambient heat conduction and radiation to the liquefied-gas and the gas comprising cryogenic fluid held in the inner container means;

(c) first heat exchanger means mounted outside the inner container means and in fluid flow communication with the inside of the inner container means, wherein liquefied-gas and the gas comprising the the cryogenic fluid held in the inner container means are movable through the first heat exchanger means to conduct heat energy to the cryogenic fluid and provide a raised-energy fluid;

(d) second heat exchanger means mounted inside the inner container means and adjacent to an inner surface thereof so that independent of the spatial orientation of the apparatus, the second heat exchanger means is at least partially immersed in the liquefied-gas so that the raised-energy fluid from the first heat exchanger means is movable through the second heat exchanger means to conduct heat energy from the raised-energy fluid to the liquefied-gas still held in the inner container means; and (e) third heat exchanger means mounted outside the inner container means and connectable for fluid flow communication with the raised-energy fluid movable thorough the second heat exchanger means and for fluid flow communication with the liquefied-gas and the gas comprising the cryogenic fluid held inside the inner container means, wherein the third heat exchanger means provides for conducting heat energy to the raised-energy fluid moved through the second heat exchanger means and to the cryogenic fluid moved directly from the inner container means to the third heat exchanger means to provide the breathable gas.

18. The apparatus of claim 17 wherein the heat exchanger means are connected in series and wherein the first and third heat exchanger means are endothermic and wherein the second heat exchanger means is exothermic.

19. The apparatus of claim 17 further comprising a by-pass means mounted between the second and third heat exchanger means, wherein the by-pass means provides for selectivity in moving the liquefied-gas and the gas comprising the cryogenic fluid directly from the inner container means to the third heat exchanger means when the pressure inside the inner container means exceeds a predetermined level.

20. The apparatus of claim 17 wherein the second heat exchanger means is comprised of a bifilar wound conduit means.

21. The apparatus of claim 17 wherein the second heat exchanger means is comprised of a conduit means mounted inside the inner container means and wherein the inner container means is comprised of a surrounding inside sidewall having opposed ends along a longitudinal axis and closed by a first and a second closure means and wherein the conduit means comprising the second conductor means includes an inlet portion that enters the inner container means through the first closure means and extends to a first coiled portion that wraps annularly around the axis at least one time adjacent to the first closure means and then extends to a first serpentine portion that winds annularly around the axis at least one time while extending towards a second coiled portion that wraps annularly around the axis at least one time adjacent to the second closure means before forming into a third coiled portion that wraps annularly around the axis at least one time adjacent to the second closure means, and wherein the third coiled portion extends to a second serpentine portion that winds annularly around the axis at least one time while extending to a fourth coiled portion that winds annularly around the axis at least one time adjacent to the first closure means before extending to an outlet portion that exits the inner container means through the first closure means.

22. The apparatus of claim 17 wherein the apparatus is adapted to be worn by a user and to be provided inside a body suit means, and wherein the heat energy conducted to the cryogenic fluid by the first heat energy conduction means and to the raised-energy fluid by the third beat energy conduction means serves to withdrawal heat energy from inside the suit means to thereby provide body cooling and decrease the relative humidity inside the suit means.

23. A method for providing a breathable gas from a cryogenic fluid comprising a liquefied-gas and a gas, which comprises:

a) providing an apparatus comprising an insulated container means holding the cryogenic fluid; first heat energy conduction means mounted outside the container means and in fluid flow communication with the inside thereof; second heat energy conduction means mounted inside the container means and at least partially immersed in the liquefied-gas independent of the direction of the gravitational field and the spatial orientation of the container means; and third heat energy conduction mounted outside the container means and connectable for fluid flow communication with the second heat energy conduction means and with the inside of the container means;

b) moving the liquefied-gas and the gas comprising the cryogenic fluid held in the container means through the first heat energy conduction means thereby conducting heat energy to the cryogenic fluid to provide a raised-energy fluid;

c) moving the raised-energy fluid from the first heat energy conduction means through the second heal energy conduction means to thereby conduct heat energy from the raised-energy fluid to the liquefied-gas still held in the container means; and d) conducting heat energy to the raised-energy fluid moving through the second heat energy conduction means and to the liquefied-gas and the gas comprising the cryogenic fluid moving directly from inside the container means by the third heat energy conduction means to thereby provide the breathable gas.

24. The method of claim 23 wherein the first, second and third heat energy conduction means are heat exchanger means.

25. The method of claim 23 further comprising a by-pass means mounted between the second and third heat exchanger conducting means, and thereby selectively moving the cryogenic fluid directly from the inner container means to the third heat exchanger conduction means when the pressure inside the inner container means exceeds a predetermined level that actuates the by-pass means.

26. The apparatus of claim 10 wherein the third coiled portion wraps annularly around the axis at least one time parallel to and in an overlapping relationship with the second coiled portion and wherein the second serpentine portion winds annularly around the axis at least one time parallel to and in an overlapping relationship with the first serpentine portion and wherein the fourth coiled portion winds annularly around the axis at least one time parallel to and in an overlapping relationship with the first coiled portion before extending to the outlet portion that exits the inner container means through the first closure means, diametrically opposite the inlet portion.

27. The apparatus of claim 21 wherein the third coiled portion wraps annularly around the axis at least one time parallel to and in an overlapping relationship with the second coiled portion and wherein the second serpentine portion winds annularly around the axis at least one time parallel to and in an overlapping relationship with the first serpentine portion and wherein the fourth coiled portion winds annularly around the axis at least one time parallel to and in an overlapping relationship with the first coiled portion before extending to the outlet portion that exits the inner container means through the first closure means, diametrically opposite the inlet portion.

28. An apparatus that is useful for holding a cryogenic fluid and that provides for conducting heat energy to the cryogenic fluid independent of the direction of the gravitational field and the spatial orientation of the apparatus to produce a breathable gas from the cryogenic fluid, which comprises:

(a) inner container means provided to hold the cryogenic fluid;

(b) insulation means housing the inner container means in a surrounding relationship to retard ambient heat conduction and radiation to the cryogenic fluid held in the inner container means;

(c) first heat energy conduction means mounted outside the inner container means and in fluid flow communication with the inside of the inner container means, wherein the cryogenic fluid held in the inner container means is movable through the first heat energy conduction means to conduct heat energy to the fluid and provide a raised energy fluid;

(d) second heat energy conduction means comprised of a conduit means mounted inside the inner container means, the inner container means comprised of a surrounding inside sidewall having opposed ends along a longitudinal axis and closed by a first and a second closure means with the conduit means comprising the second heat energy conduction means having an inlet portion that enters the inner container means through the first closure means and extends to a first coiled portion that wraps annularly around the axis at least one time adjacent to the first closure means and then extends to a first serpentine portion that winds annularly around the axis at least one time while extending towards a second coiled portion that wraps annularly around the axis at least one time adjacent to the second closure means before forming into a third coiled portion that wraps annularly around the axis at least one time adjacent to the second closure means, wherein the third coiled portion extends to a second serpentine portion that winds annularly around the axis at least one time and extends to a fourth coiled portion that winds annularly around the axis at least one time adjacent to the first closure means before extending to an outlet portion that exits the inner container means through the first closure means such that the second heat energy conduction means is at least partially immersed in the cryogenic fluid independent of the spatial orientation of the apparatus, and wherein the raised-energy fluid from the first heat energy conduction means is movable through the second heat energy conduction means to conduct heat energy from the raised-energy fluid to the cryogenic fluid still held in the inner container means; and (e) third heat energy conduction means mounted outside the inner container means and connectable for fluid flow communication with the second heat energy conduction means and with the inside of the inner container means, wherein the third heat energy conduction means provides for conducting heat energy to the raised-energy fluid moved through the second heat energy conduction means and to the cryogenic fluid moved directly from the inner container means to the third heat energy conduction means to provide the breathable gas.

29. The apparatus of claim 28 wherein the third coiled portion wraps annularly around the axis at least one time parallel to and in an overlapping relationship with the second coiled portion and wherein the second serpentine portion winds annularly around the axis at least one time parallel to and in an overlapping relationship with the first serpentine portion and wherein the fourth coiled portion winds annularly around the axis at least one time parallel to and in an overlapping relationship with the first coiled portion before extending to the outlet portion that exits the inner container means through the first closure means, diametrically opposite the inlet portion.

30. The apparatus of claim 28 wherein the surrounding inside sidewall comprising the inner container means has a cylindrical shape along and around the longitudinal axis and wherein the first and the second closure means are spherical- or ellipsoidal-shaped dome members that close the opposed end of the cylinder.

31. An apparatus that is useful for holding a cryogenic fluid and that provides for conducting heat energy to the fluid independent of the direction of the gravitational field and the spatial orientation of the apparatus to produce a breathable gas from the cryogenic fluid, which comprises:

(a) inner container means provided to hold the cryogenic fluid;

(b) insulation means housing the inner container means in a surrounding relationship to retard ambient heat conduction and radiation to the cryogenic fluid held in the inner container means;

(c) first heat exchanger means mounted outside the inner container means and in fluid flow communication with the inside of the inner container means, wherein the cryogenic fluid held in the inner container means is movable through the first heat exchanger means to conduct heat energy to the fluid and provide a raised-energy fluid;

(d) second heat exchanger means mounted inside the inner container means and comprised of a conduit means mounted adjacent to an inner surface thereof, the inner container means comprised of a surrounding inside sidewall having opposed ends along a longitudinal axis and closed by a first and a second closure means, wherein the conduit means comprising the second conductor means includes an inlet portion that enters the inner container means through the first closure means and extends to a first coiled portion that wraps annularly around the axis at least one time adjacent to the first closure means and then extends to a first serpentine portion that winds annularly around the axis at least one time while extending towards a second coiled portion that wraps annularly around the axis at least one time adjacent to the second closure means before forming into a third coiled portion that wraps annularly around the axis at least one time adjacent to the second closure means, and wherein the third coiled portion extends to a second serpentine portion that winds annularly around the axis at least one time and extends to a fourth coiled portion that winds annularly around the axis at least one time adjacent to the first closure means before extending to an outlet portion that exits the inner container means though the first closure means so that independent of the spatial orientation of the apparatus, the second heat exchanger means is at least partially immersed in the cryogenic fluid with the raised-energy fluid from the first heat exchanger means movable through the second heat exchanger means to conduct heat energy from the raised-energy fluid to the cryogenic fluid still held in the inner container means; and (e) third heat exchanger means mounted outside the inner container means and connectable for fluid flow communication with the second heat exchanger means and with the inside of the inner container means, wherein the third heat exchanger means provides for conducting heat energy to the raised-energy fluid moved through the second heat exchanger means and to the cryogenic fluid moved directly from the inner container means to the third heat exchanger means to provide the breathable gas.

32. The apparatus of claim 31 wherein the third coiled portion wraps annularly around the axis at least one time parallel to and in an overlapping relationship with the second coiled portion and wherein the second serpentine portion winds annularly around the axis at least one time parallel to and in an overlapping relationship with the first serpentine portion and wherein the fourth coiled portion winds annularly around the axis at least one time parallel to and in an overlapping relationship with the first coiled portion before extending to the outlet portion that exits the inner container means through the first closure means, diametrically opposite the inlet portion.

33. An apparatus that is useful for holding a cryogenic fluid and that provides for conducting heat energy to the cryogenic fluid independent of the direction of the gravitational field and the spatial orientation of the apparatus to produce a breathable gas from the cryogenic fluid, which comprises:

(a) inner container means provided to hold the cryogenic fluid;

(b) insulation means housing the inner container means in a surrounding relationship to retard ambient heat conduction and radiation to the cryogenic fluid held in the inner container means;

(c) first heat energy conduction means mounted outside the inner container means and in fluid flow communication with the inside of the inner container means, wherein the cryogenic fluid held in the inner container means is movable through the first heat energy conduction means to conduct heat energy to the fluid and provide a raised energy fluid;

(d) second heat energy conduction means comprised of a conduit means mounted inside the inner container means, the inner container means comprised of a surrounding inside sidewall having opposed ends along a longitudinal axis and closed by a first and a second closure means with the conduit means comprising the second heat energy conduction means having an inlet portion that enters the inner container means through the first closure means and extends to a serpentine portion that winds annularly around the axis at least one time while extending adjacent to the second closure means before forming into an outlet portion that exits the inner container means through the second closure means such that the second heat energy conduction means is at least partially immersed in the cryogenic fluid independent of the spatial orientation of the apparatus, and wherein the raised-energy fluid from the first heat energy conduction means is movable through the second heat energy conduction means to conduct heat energy from the raised-energy fluid to the cryogenic fluid still held in the inner container means; and (e) third heat energy conduction means mounted outside the inner container means and connectable for fluid flow communication with the second heat energy conduction means and with the inside of the inner container means, wherein the third heat energy conduction means provides for conducting heat energy to the raised-energy fluid moved through the second heat energy conduction means and to the cryogenic fluid moved directly from the inner container means to the third heat energy conduction means to provide the breathable gas.

34. An apparatus that is useful for holding a cryogenic fluid and that provides for conducting heat energy to the cryogenic fluid independent of the direction of the gravitational field and the spatial orientation of the apparatus to produce a breathable gas from the cryogenic fluid, which comprises:

(a) inner container means provided to hold the cryogenic fluid;

(b) insulation means housing the inner container means in a surrounding relationship to retard ambient heat conduction and radiation to the cryogenic fluid held in the inner container means;

(c) first heat energy conduction means mounted outside the inner container means and in fluid flow communication with the inside of the inner container means, wherein the cryogenic fluid held in the inner container means is movable through the first heat energy conduction means to conduct heat energy to the fluid and provide a raised energy fluid;

(d) second heat energy conduction means comprised of a conduit means mounted inside the inner container means, the inner container means comprised of a surrounding inside sidewall having opposed ends along a longitudinal axis and closed by a first and a second closure means with the conduit means comprising the second heat energy conduction means having an inlet portion that enters the inner container means through the first closure means and extends to a first serpentine portion that winds annularly around the axis at least one time while extending adjacent to the second closure means before forming into a second serpentine portion that winds annularly around the axis at least one time while extending adjacent to the first closure means before forming into an outlet portion that exits the inner container means through the first closure means such that the second heat energy conduction means is at least partially immersed in the cryogenic fluid independent of the spatial orientation of the apparatus, and wherein the raised-energy fluid from the first heat energy conduction means is movable through the second heat energy conduction means to conduct heat energy from the raised-energy fluid to the cryogenic fluid still held in the inner container means; and (e) third heat energy conduction means mounted outside the inner container means and connectable for fluid flow communication with the second heat energy conduction means and with the inside of the inner container means, wherein the third heat energy conduction means provides for conducting heat energy to the raised-energy fluid moved through the second heat energy conduction means and to the cryogenic fluid moved directly from the inner container means to the third heat energy conduction means to provide the breathable gas.

35. A method for providing a breathable gas from a cryogenic fluids which comprises:

a) providing an apparatus comprising an insulated container means holding the cryogenic fluid; first heat energy conduction means mounted outside the container means and in fluid flow communication with the inside thereof; second heat energy conduction means comprised of a conduit means mounted inside the container means, the inner container means comprised of a surrounding inside sidewall having opposed ends along a longitudinal axis and closed by a first and a second closure means with the conduit means comprising the second heat energy conduction means having an inlet portion that enters the inner container means through the first closure means and extends to a first coiled portion that wraps annularly around the axis at least one time adjacent to the first closure means and then extends to a first serpentine portion that winds annularly around the axis at least one time while extending toward a second coiled portion that wraps annularly around the axis at least one time adjacent to the second closure means before forming into a third coiled portion that wraps annularly around the axis at least one time adjacent to the second closure means and wherein the third coiled portion extends to a second serpentine portion that winds annularly around the axis at least one time and extends to a fourth coiled portion that winds annularly around the axis at least one time adjacent to the first closure means before extending to an outlet portion that exits the inner container means through the first closure means such that the second heat energy conduction means is at least partially immersed in the cryogenic fluid independent of the spatial orientation of the container means; and third heat energy conduction means mounted outside the container means and connectable for fluid flow communication with the second heat energy conduction means and with the inside of the container means;

b) moving the cryogenic fluid held in the container means through the first heat energy conduction means thereby conducting heat energy to the fluid to provide a raised-energy fluid;

c) moving the raised-energy fluid from the first heat energy conduction means through the second heat energy conduction means to thereby conduct heat energy from the raised-energy fluid to the cryogenic fluid still held in the container means; and d) conducting heat energy to the raised-energy fluid moving through the second heat energy conduction means and to the cryogenic fluid moving directly from inside the container means by the third heat energy conduction means to thereby provide the breathable gas.

36. The method of claim 35 wherein the third coiled portion wraps annularly around the axis at least one time parallel to and in an overlapping relationship with the second coiled portion and wherein the second serpentine portion winds annularly around the axis at least one time parallel to and in an overlapping relationship with the first serpentine portion and wherein the fourth coiled portion winds annularly around the axis at least one time parallel to and in an overlapping relationship with the first coiled portion before extending to the outlet portion that exits the inner container means through the first closure means, diametrically opposite the inlet portion.

* * * * *